United States Patent [19]

Grass

[11] Patent Number: 4,493,129

[45] Date of Patent: Jan. 15, 1985

[54] DOOR HINGE FOR LATERAL AND HEIGHTH ADJUSTMENT

[76] Inventor: Alfred Grass, Konsumstrasse 20, A-6973 Höchst/Vlbg., Austria

[21] Appl. No.: 366,765

[22] Filed: Apr. 8, 1982

[30] Foreign Application Priority Data

Apr. 9, 1981 [DE] Fed. Rep. of Germany ..... 3114424

[51] Int. Cl.[3] ..... E05D 7/04

[52] U.S. Cl. ..... 16/238; 16/246; 16/332; 16/DIG. 39

[58] Field of Search ..... 16/238, 243, 246, 248, 16/382, 327, 332, 352, 292, 297, 317, 245, DIG. 43, DIG. 39, 237, 240

[56] References Cited

U.S. PATENT DOCUMENTS

| | | | |
|---|---|---|---|
| 2,035,144 | 3/1935 | Cerami | 16/297 X |
| 2,615,194 | 3/1947 | Kreiner | 16/248 |
| 3,977,042 | 8/1976 | Lautenschlaeger | 16/238 |
| 4,210,979 | 7/1980 | Boyd | 16/327 |

FOREIGN PATENT DOCUMENTS 1782943 8/1978 Fed. Rep. of Germany .

*Primary Examiner*—Mark Rosenbaum

*Assistant Examiner*—Joseph M. Gorski

*Attorney, Agent, or Firm*—Parmelee, Miller, Welsh & Kratz

[57] ABSTRACT

An improved hinge construction is provided having cam and spring means for maintaining it in its open and/or closed positions and importantly, having parts enabling it to be adjusted as to its positioning between a door and a door frame after it has been secured in position therebetween. Adjustment in its heighth and lateral relationships may be independently accomplished. A screw is carried by the boss of a screw-on mounting plate and cooperates with a so-called driving dog to effect lateral adjustment between the mounting place and a swing or operating arm and thus, between the door frame and the door, itself. Heighth adjustment is accomplished independently by loosening a mounting or fastening screw that is used to secure the swing arm to the boss, sufficiently to enable cross adjustment between cooperating serrations carried by them. The lateral adjustment is accomplished, while retaining the cooperating serrations in their previously aligned relation, by moving the elements along rather than across such serrations.

10 Claims, 4 Drawing Figures

DOOR HINGE FOR LATERAL AND HEIGHTH ADJUSTMENT

This invention pertains to an improved hinge in which heighth and lateral or cross adjustments may be made from the standpoint of its mounted relation between a door and its frame without adversely affecting either adjustment.

It has been an object of the invention to provide a simple and practical type of hinge that not only is substantially fully hidden when a door is in its fully closed position, but which is freely accessible for heighth and lateral adjustments;

Another object has been to devise a hinge in which lateral and heighth or two opposite directions of adjustment may be made between its parts after it has been semi-permanently mounted in position between a door and a frame;

A further object of the invention has been to provide an improved hinge that will solve a problem heretofore existing in the art as to final adjustments of the mounted relation of the hinge parts with respect to each other, such that one direction of adjustment may be made independently and without changing an adjustment made in the other direction.

Figure 3:
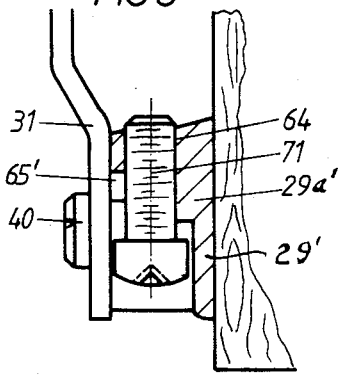
FIG. 3 is a fragmental horizontal or lateral section of a slightly modified embodiment of the hinge construction as shown in a mounted relation with respect to a door frame.
Figure 4:
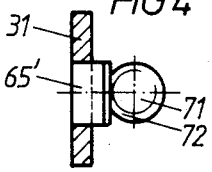

and, FIG. 4 is a vertical somewhat schematic detail section of the modified construction of FIG. 3, taken at right angles to FIG. 3.

DETAILED DESCRIPTION OF THE CONSTRUCTION

Figure 1:
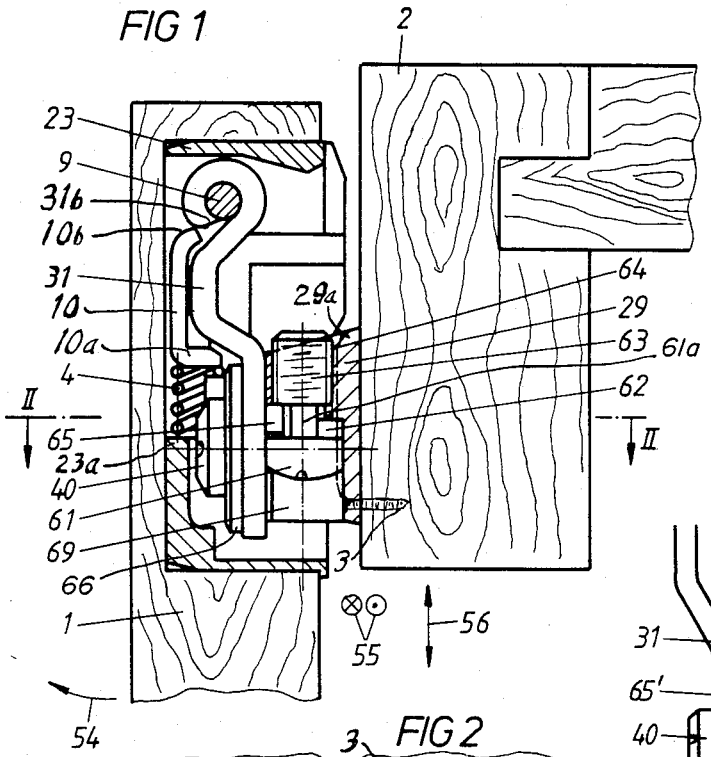
FIG. 1 is a horizontal or lateral section taken through a hinge of the invention in a mounted and closed relation between a frame and a door that is to be opened and closed with respect thereto.
Figure 2:
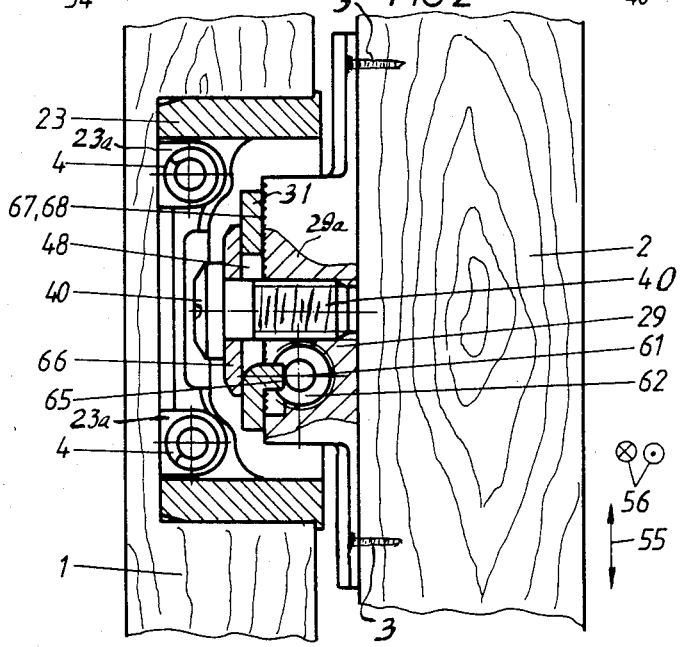
FIG. 2 is a vertical section on the scale of and taken along the line II—II of FIG. 1.

Basically, the construction of the invention from the standpoint of the embodiment of FIGS. 1 and 2 and the slightly modified embodiment of FIGS. 3 and 4 involves an operative combination, such that both lateral or cross adjustment may be made between the mounted relationship of the door with respect to its frame without changing or effecting in any way the adjustment of the door in its right angular or heighth relationship with respect to the frame, and vice-versa. It will be appreciated by those skilled in the art that customarily, a pair of hinges are used for mounting doors, although in some instances, a door of a very light construction may be sufficiently mounted by a single hinge. The construction of the hinge of the present invention enables one or more hinges to be securely mounted between a door and its frame, and to thereafter be independently adjusted after mounting, both laterally and heightwise with respect to or between the door and its frame.

Although a good carpenter or workman may be able to mount hinges in a fairly accurate and proper relation between a door and its frame, it has been found that this requires rather meticulous work and that, even in such a case, there may be a slight-off alignment. For maximum efficiency of operation and aesthetic appearance, at least slight after adjustments become advisable. Also, off-alignment has become an important factor today, since much of this type of work is being done by relatively unskilled "do it yourselfers". By reason of the fact that two directions of adjustment may be effected independently of each other, the best mounting relation may be attained between the door and its frame, and thereafter attained if, for some reason, the relation needs to be later readjusted. Frequently, after a period of use under various atmospheric conditions, there may be a tendency for the door to lose its proper relation with respect to the frame or vice-versa and further minor adjustment then becomes desirable.

In the construction illustrated in the drawings, a door 1 is shown hingeably mounted on a frame 2 by means of a hinge box 23 inset within a slot or opening cut into the door from its back side, and as surrounded on all sides by wall portions of the door. This box 23 may be mounted in position by any suitable means, such as by a pair of wood screws that extend through the side walls thereof into the door (not shown for clarity of illustration). The other mounting part of the hinge which may be termed a screw-on mounting plate 29 is shown mounted on the face of the frame 2, as by wood screws 3 that extend through flange portions thereof. An operating and supporting swing arm 31 is operatively connected between the box 23 and the plate 29 to serve as the direct hinge means for opening and closing the door. As shown particularly in FIG. 1, the arm 31 has a bent-over end portion pivotally mounted on a hinge pin 9 that is secured to and extends from within the door-mounted box 23. The respective mountings of the box 23 and the plate 29 may, if desired, be reversed from the standpoint of the door and its frame, that is, between two furniture parts that are to be opened and closed with respect to each other.

To permit the door 1 to be easily swung from a closed to an open position and back again and, at each such position, to have a position-holding relation, a pair of coil springs 4 are shown in FIGS. 1 and 2 as mounted within the box 23 to, at one of their ends, abut a ledge portion **23*a* thereof and to, at their other ends, abut a somewhat angle-shaped latching element or piece 10. It will be noted that one end of the latching element 10 has an angle-shaped foot portion 10*a* which abuts the other end of the coil springs 4. The other end 10*b* of the element 10 is slightly rounded or curved and turned-in (see FIG. 1) to provide a camming face that is flexibly urged into engagement with a cooperating camming face portion 31*b* of the operating and supporting swing arm 31. FIG. 1 shows the relationship between the rounded end portion 10*b* and the camming face portion 31*b* when the door 1 is in its fully closed relation with respect to the frame 1. When the door is opened, the curved portion 10*b* moves into a slot defined by the face 31*b* of the opposed, bent-in, and somewhat rounded end of the arm 31 to, in effect, provide an outwardly, flexibly latched relation of the door 1**.

The screw-on mounting plate 29 has a forwardly projecting, boss or hub-like portion **29*a* extending within the hinge box 23 when the hinge is in its door-closing position, see particularly FIG. 2. The hub portion 29*a*, as shown has a threaded bore therein which is adapted to threadably receive a fastening screw 40. The fastening screw 40 cooperates with a clamping washer 66 to securely mount the extending or forward end of the supporting swing arm 31 on the hub portion 29*a* in a clamped-on relation with respect thereto. As indicated in FIG. 2, the front face of the hub portion 29a is serrated or has cross serrations or teeth and grooves that cooperate with like serrations or teeth and grooves along the opposed face of the arm 31. Thus, when the fastening screw 40 is tightened-down, it positively retains the operating arm 31 in a selected heighth adjustment with respect to the plate 29 in its mounted relation on the front face of the frame 2, see wood screw 3. This adjustment is longitudinal or axial with respect to the hinge axis represented by the pin 9**.

An angle-shaped, so-called drive or latching dog element 65 of the arm 31 is adapted to be positioned between the clamping washer 66 and the front face of the hub or boss portion 29a of the screw-on plate 29 to, at its one end extend into a radial circular groove 62 that extends into the boss 29a (see FIG. 1) and into a threaded bore in which the enlarged threaded end of the fastening screw 40 extends. As shown in FIG. 1, a lateral adjustment screw 61 is adapted to be mounted within a threaded bore hole extending from the groove 69 in the hub or boss portion 29a. The adjustment screw 61 has a threaded, enlarged diameter end portion 63 that adjustably threadably extends along threaded bore 69 and has a smaller diameter neck portion 61a adjacent to its head. Latching dog or element 65 is adapted to be positioned within spacing or a radial circular groove adjacent the smaller diameter neck 61a. Thus, adjustment of the lateral positioning of the door 1 with respect to the frame 2, can be accomplished by adjusting the position of the screw 61 within the threaded bore 64. This lateral adjustment is accomplished while retaining cooperating serrated or teeth-like opposed surfaces of the arm 31 and the boss 29a (see FIG. 2) in a guided relation, such that cross, as distinguished from lengthwise relative movement therebetween cannot be effected.

Heighth adjustment may be accomplished independently of such lateral adjustment by loosening, fastening or clamping screw 40 sufficiently within its positioning in a threaded axial bore of the boss 29a to enable the serrated surface of the arm 31 to move out of one complementary teeth engagement with the cooperating serrated surface of the boss 29a into a second cooperating interfitting relation. At this time, the screw 40 may be tightened-down to retain the adjusted relation therebetween.

In the slightly modified construction of FIGS. 3 and 4 of the drawings, the dog 65' has a rectangular-like shape and, at its inner end, is provided with threads which are adapted to mesh or cooperate with threads of adjustment screw 71. The adjustment screw 71 has a threaded stem of the same diameter throughout. In this embodiment, the latching or driving dog 65' meshes with and is carried along the threads 72 of the adjustment screw 71 to enable a lateral adjustment of the relationship between the operating arm 31 and the boss 29a' of the screw-on plate 29'.

In the construction as set forth and described in connection with FIGS. 1 and 2, it will be noted that there are two screws 40 and 61 that are involved in adjusting the hinge construction, namely, the so-called fastening screw 40 which enables lateral adjustment as shown by the arrows 56 of FIGS. 1 and 2, and the adjustment screw 61 which enables heighth, right-angular adjustment, as represented by the arrows 55 of the same figures.

In the embodiment of FIGS. 3 and 4, the screw 71 serves the same general function as the screw 61 of the embodiment of FIGS. 1 and 2.

The springs 4 act as closing elements in which pressure is exerted in an axial direction to accomplish a flexible operation of the swing arm 31 when the door is moved relative to the frame between open and closed positions. That is, the curved camming surfaces of 10b and 31b are shaped with respect to each other to enable a flexible retention of the door in one or more desired positions, and in such a manner that once the initial holding force is overcome that the door 1 may be easily moved or swung to a second holding position.

The construction is such that, a displacement clearance is enabled in effecting adjustment between the swing arm 31 and the boss or hub portion 29a of the mounting plate 29. It will be apparent that the guiding grooves and teeth of the cooperating serrated surfaces between the swing arm 31 and the forward face of the boss 29a (see FIG. 2) enable an adjustment in one direction independent of adjustment in a perpendicular direction while retaining the adjustment in the perpendicular direction and vice-verse. It is only necessary to loosen the fastening screw 40 sufficiently within the boss 29a to enable heighth adjustment between the hinge parts by moving one set of grooves and teeth into a different cooperating or complementary relation with respect to the other set. Thereafter, the screw 40 may be tightened-down to retain them in such a relation. The screw 40 may also be slightly loosened to facilitate lateral adjustment, for example, in which the parts move along, instead of across the teeth grooves of the serrations, and which is effected by the adjustment screw 61. When the heighth adjustment is being made, the so-called driving dog 65 of the swing and support arm 31 may be freely displaced in the direction of heighthwise adjustment. This enables the dog to be displaced tangentially in the circular groove 61 and to such an extent that a dog will always remain in contact with such groove. The displacement clearance involved may, for example, be $\pm 2$ mm.

In the embodiment of FIGS. 3 and 4, the adjustment screw 71 has its own threading 72. The threads 72 of adjustment screw 71 directly mesh with teeth of the drive dog 65' which is an extension of the supporting swing arm 31. When the fastening screw 40 is loosened, the adjustment screw 71 when turned, will carry the dog 65' along with it in such a manner as to effect lateral adjustment. Dependent on the type of threads 72 used for the screw 71 whether trapezoidal, triangular or flat, there is enabled heighthwise adjustment in the direction of the arrows 55 of FIGS. 1 and 2 without changing the lateral adjustment.

A substantial advantage of the invention lies in the fact there may be provided gradual adjustments in the lateral direction 56 without any changes in the heighth adjustment 55 and vice-versa. In other words, each adjustment may be accomplished independently and without adversely effecting previous adjustment made as to the other. Further, the adjustments are accomplished without adversely effecting the desired opening and closing, as well as position retaining action of the hinge from the standpoint of its supporting and swing arm 31. In FIG. 1, the direction of opening movement between door member 1 and frame member 2 is indicated by the arrow 54.

I claim:

1. A door hinge for substantially concealed door-closed mounting with respect to a supporting frame member which enables dual-way direction of adjustment between a frame member and a door member which comprises, a hinge box having a back end adapted to be positioned and secured in a depthwise-inserted relation from a face portion of and within one of a frame member and a door member, a mounting plate adapted to be secured on an opposed face portion of the other of the members, a swing arm fully within the box, the swing arm having a back end portion pivotally mounted within said box to extend substantially parallel to the back of the box when the door member is in a closed position with respect to the frame member, a boss fixedly secured to the mounting plate so as to extend from said mounting plate towards said box to extend therewithin when the door member is in a closed position with respect to the frame member, said swing arm having a forward end portion extending into a cooperating position with respect to said boss, said boss having screw means cooperating with said forward end portion for mounting said swing arm in a two-way independently adjustable relation on and with respect to said boss to enable lateral as well as heighth adjustment between said box and said mounting plate after they have been secured in a mounted position on the door and frame members.

2. A door hinge as defined in claim 1 wherein, said back end portion of said swing arm has a cam surface, and a spring-pressed latching member has a cooperating cam surface to flexibly retain the door member in at least one selected position with respect to the frame member.

3. A door hinge as defined in claim 1 wherein, said box has a ledge portion therein, a latching member is operatively positioned within said box to at one end engage said back end portion of said swing arm, and spring means is positioned in said box to extend between said ledge portion and an opposite end of said latching member to retain said latching member in an operating relation with respect to said back end portion of said swing arm.

4. A door hinge as defined in claim 1 wherein, said boss has a serrated surface portion, said forward end portion of said swing arm has a serrated surface portion that is adapted to be positioned in complementary engagement with the serrated surface portion of said boss, a latching dog extends from said forward end portion of said swing arm, said boss has a circular slot therein adapted to receive said latching dog therein, said screw means has one screw adapted to enable heighth adjustment between said swing arm and said boss along said serrated surface portions in their complementary engagement with respect to each other, and said screw means has a second screw cooperating with said latching dog to independently adjust a lateral across cooperating relation between said serrated surface portions within disturbing heighth adjustment effected therebetween by said one screw.

5. A door hinge as defined in claim 4 wherein said latching dog has a threaded surface in cooperating engagement with threads of said second screw for adjusting movement therewith.

6. An adjustable hinge for substantially concealed door-closed mounting and for enabling dual-way directional adjustment between a frame member and a door member that are to be opened and closed with respect to each other which comprises, a hinge box adapted to be mounted in a depthwise-inserted relation from a face portion of and within a wall portion of one of a frame member and a door member, a mounting plate adapted to be secured on an opposed face portion of the other of the members and having a boss fixedly secured to the mounting plate adapted to extend within said box when the members are in a closed relation with respect to each other, a supporting swing arm pivotally mounted at a back end portion of the box and fully within said box and adjustably connected at its other and forward end portion to said boss for enabling opening and closing movement between the frame and door members, means for mounting said forward end portion of said swing arm on said boss, and means cooperating with said mounting means for independently effecting lateral and heighth adjustment solely between said swing arm and said boss in two angularly offset directions with respect to each other.

7. An adjustable door hinge as defined in claim 6 wherein, said mounting means provides a pair of cooperating serrated engaging surfaces between said boss and said supporting swing arm, and said cooperating means comprises: a first screw carried by said boss for solely adjusting cross-extending engagement of said serrated surfaces with respect to each other, and a second screw carried by said boss for solely and independently adjusting said serrated surfaces in a longitudinally aligned relation with respect to each other.

8. An adjustable door hinge as defined in claim 7 wherein, said boss has a pair of threaded bores therein that extend in a substantially right angular relation with respect to each other for respectively receiving said first and second screws therein, said first screw has a neck portion of reduced diameter, and said forward end portion of said supporting swing arm has a cooperating relation with said neck portion to follow adjusting movement of said first screw.

9. An adjustable door hinge as defined in claim 6 wherein said cooperating means comprises: a dog extending from said forward end portion of said swing arm, a slot within said boss within which said dog is positioned, and screw means cooperating with said dog and said boss for adjusting said swing arm and said boss in a lateral direction with respect to each other.

10. An adjustable door hinge as defined in claim 6 wherein said boss and said forward end portion of said swing arm have cooperating adjustment surfaces, and said cooperating means comprises screw means for independently adjusting said surfaces both laterally and heighthwise with respect to each other.

* * * * *